US005911794A

United States Patent [19]

Nordhoff

[11] Patent Number: 5,911,794

[45] Date of Patent: Jun. 15, 1999

[54] TOOL AND METHOD FOR MANIPULATING A BEVERAGE CONTAINER TAB

[76] Inventor: Scott Nordhoff, 1415 18th St., Bedford, Ind. 47421

[21] Appl. No.: 09/027,874

[22] Filed: Feb. 23, 1998

[51] Int. Cl.[6] ..... B67B 7/16; B67B 7/44; A47G 19/22

[52] U.S. Cl. ..... 81/3.55; 81/315; 220/713

[58] Field of Search ..... 81/3.09, 3.55, 81/3.15; 220/719, 711, 713, 212

[56] References Cited

U.S. PATENT DOCUMENTS

| | | | |
|---|---|---|---|
| 4,391,167 | 7/1983 | Bergmeister . | |
| 4,455,894 | 6/1984 | Roberts . | |
| 4,602,723 | 7/1986 | DeMars . | |
| 4,846,024 | 7/1989 | Bryant et al. . | |
| 4,864,898 | 9/1989 | Tricinella . | |
| 4,873,896 | 10/1989 | Hull . | |
| 4,913,304 | 4/1990 | Corey . | |
| 4,917,258 | 4/1990 | Boyd et al. | 220/240 |
| 4,967,622 | 11/1990 | Phillips . | |
| 5,110,002 | 5/1992 | Tucker | 220/254 |
| 5,165,579 | 11/1992 | Lund . | |
| 5,203,467 | 4/1993 | Tucker | 220/254 |
| 5,240,132 | 8/1993 | Tucker | 220/212 |
| 5,402,904 | 4/1995 | Close | 220/254 |
| 5,509,380 | 4/1996 | Tipp . | |
| 5,621,936 | 4/1997 | Penaligon et al. . | |

*Primary Examiner*—David A. Scherbel
*Assistant Examiner*—Philip J. Hoffmann
*Attorney, Agent, or Firm*—Woodard, Emhardt, Naughton, Moriarty & McNett

[57] ABSTRACT

A method and tool for manipulating an opening tab mounted on a beverage container. The tool has an elongate body having a front-end, an opposing distal end, a top face and a lower face. An internal channel is defined within the elongate body beginning in the front-end and extending lengthwise within the elongate body. The internal channel is sized at least as high, as least as wide and at least as long as the tab. A cut-away is made in the lower face of the elongate body. The cut-away communicates with the internal chamber to allow the elongate body to be positioned or slid with the tab held within the internal channel. The elongate body extends past the site where the tab is mounted and the top face of the elongate body substantially covers the tab. A groove is defined in the lower face of the elongate body distally from the front-end. The groove is sized and spaced to grip the rim of the container. The tool may be used to open the container, to protect facial hair or sensitive skin of the user or may be rotated to cover the container opening to deter insects or foreign matter from entering the container.

10 Claims, 3 Drawing Sheets

TOOL AND METHOD FOR MANIPULATING A BEVERAGE CONTAINER TAB

FIELD OF THE INVENTION

The present invention relates generally to beverage containers, and more particularly to a tool and method for manipulating opening tabs mounted on beverage containers.

BACKGROUND OF THE INVENTION

Beverage containers such as soda cans or beer cans are well known to the public and pervasive in society. These beverage containers are generally cylindrically shaped and formed from steel or aluminum. The cans are frequently sized for 12 fluid ounces and are used for a variety of beverages such as soda pop, juice or beer. Often these cans are refrigerated or placed in ice to chill the beverage contents. Individuals may drink directly from the container or may pour the beverage into a receptacle such as a tumbler.

During manufacture, a cap or lid is placed on the top of the container after the container is filled with a beverage under pressure. The lid is sealed and functions to retain the contents under pressure until the beverage is to be consumed. As is well known, these lids have a scored section to form a flap which is intended to be easily opened by lifting one end of a tab mounted on the lid whereby the other end of the tab impinges upon and opens the flap within the scored section. The tab is mounted on a point that defines a central pivot point on the lid.

Unfortunately, it is sometimes more difficult to open such a container than intended. If the tab is attached tightly to the lid, it may be difficult for a person to get a sufficient hold on the tab, particularly, for examples, if the person has short fingernails or wishes to protect their fingernails. Additionally, when the tab is lifted, it has been known that the connection point where the tab is mounted has failed and the tab is torn from the lid with the flap remaining closed or only partially opened. A further disadvantage arises when a person applies force to the can when opening and the can opens suddenly which can spill the contents. Accordingly, it is known to use a tool to aid in holding the tab while connected to the lid and to aid in directing sufficient force against the scored portion to smoothly and completely open the container. This is especially useful for people, such as waitresses, who open cans repetitively.

These containers also suffer from certain disadvantages during use. For instance, the tabs on many of these containers are normally formed with cut-outs and with the edges slightly folded back. The openings and edges of these tabs have been known to grab or snag mustache hairs so that these hairs are tugged or even torn when the container is moved away from the person's face. This can be an annoyance to people with facial hair, such as a mustache, who are sipping the beverage from the can. The roughness of the tabs can also irritate chapped or tender skin of the user.

The sugar in many of these beverages is also a lure to insects or pests, such as bees. If a bee enters an open container, it can contaminate the beverage, and the individual can be in danger of being stung or even accidentally swallowing the bee when sipping from the container. Another danger is contamination from a foreign object falling into the container. Accordingly, there is a need for a simple method for making these containers more comfortable for people with mustaches and for impeding insects such as bees or other foreign matter from entering the containers.

One device for use with beverage cans is illustrated in U.S. Pat. No. 4,602,723, issued to DeMars. DeMars teaches a handle for use with a beverage can so that the user may, due to cold, avoid direct contact with the can during use. DeMars teaches a handle having an upper portion which receives the free end of a pull-tab, a downward shank and a lower portion which grips the edge of the bottom of the can. DeMars' device may be used to aid in initially grabbing the pull-tab, but fails to aid in directing force against the scored section to the lid. Additionally, DeMars' device uncomfortably allows facial hair to be tangled in the pull-tab, and does not impede access by insects or foreign matter into the container.

There remains a need for a tool and method to easily and simply manipulate tabs on beverage containers, to aid in the comfort of users and to prevent contamination or access by insects or foreign matter. The present invention addresses that need.

SUMMARY OF THE INVENTION

Illustrated is a preferred embodiment of a tool and method for manipulating an opening tab mounted on a beverage container. The tool has an elongate body having a length, a front-end, a top face and a lower face. An internal channel is defined within the elongate body beginning in the front-end and extending lengthwise within the elongate body. The internal channel is sized at least as high, as least as wide and at least as long as the tab. A cut-away is made in the lower face of the elongate body. The cut-away is in communication with the internal chamber to allow the elongate body to be positioned or slid around the tab which is held within the internal channel, so that the elongate body extends past the site where the tab is mounted and the top face of the elongate body substantially covers the tab. A groove is defined in the lower face of the elongate body distally from the front-end. The groove is sized and spaced to form a pressure fit with a rim of the container.

The tool prevents the tab from grabbing or becoming tangled in facial hair of the user and also hinders insects or foreign matter from entering the container. The tool may also be used to hold the tab out of the way of the user during use.

It is an object of the present invention to provide a tool and method for manipulating a tab on a beverage container.

It is a further preferred object of the present invention to provide a tool to increase the comfort of users.

It is another preferred object of the present invention to provide a method for deterring insects or foreign matter from entering a container.

Further objects features and advantages of the present invention shall become apparent from the detailed drawings and descriptions provided herein.

DESCRIPTION OF THE PREFERRED EMBODIMENT

Figure 1:
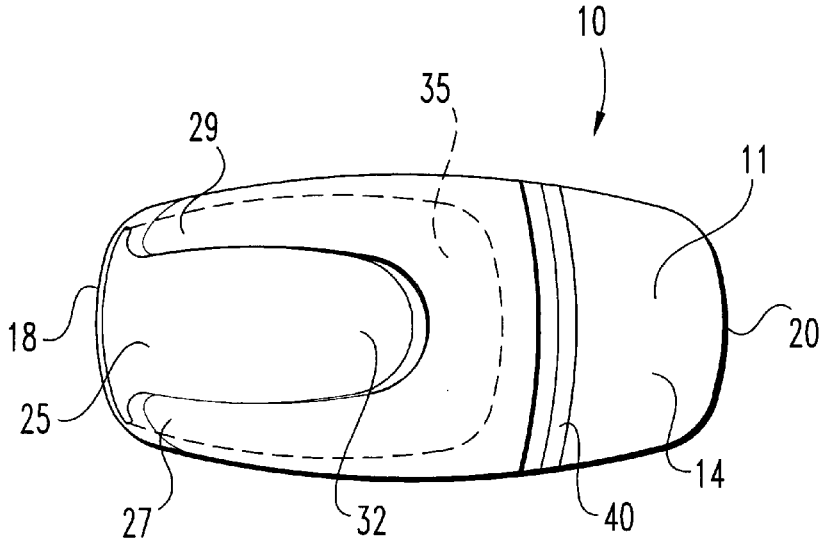
FIG. 1 is a perspective view of the lower face of the invention according to a preferred embodiment.

For the purposes of promoting an understanding of the principles of the invention, reference will now be made to the embodiment illustrated and specific language will be used to describe the same. It will nevertheless be understood that no limitation of the scope of the invention is thereby intended, such alterations, modifications, and further applications of the principles of the invention being contemplated as would normally occur to one skilled in the art to which the invention relates.

The tool and method of the present invention allows for easier and simpler manipulation of an opening tab mounted on a beverage container and contributes to the comfort of the user. As illustrated in FIGS. 1, 2A, 2B, 3A, and 3B, tool 10 is formed from elongate body 11, having top face 12, lower face 14, front-end 18 and distal end 20. Internal channel 25 is cut in elongate body 11 beginning in front end 18 and continuing lengthwise along elongate body 11. Cut-away section 32 is cut in lower face 14 of elongate body 11 and communicates with internal channel 25. Groove 40 is cut in lower face 14 of elongate body 11 adjacent to distal end 20. IN a preferred embodiment 11 has a length between about 1⅜" and 2", most preferably about 1⅝".

Figure 2A:
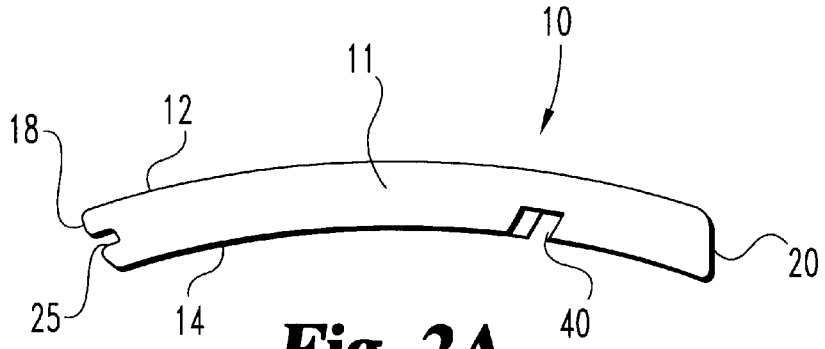
FIG. 2A is a perspective side view of the invention according to one preferred embodiment.
Figure 2B:
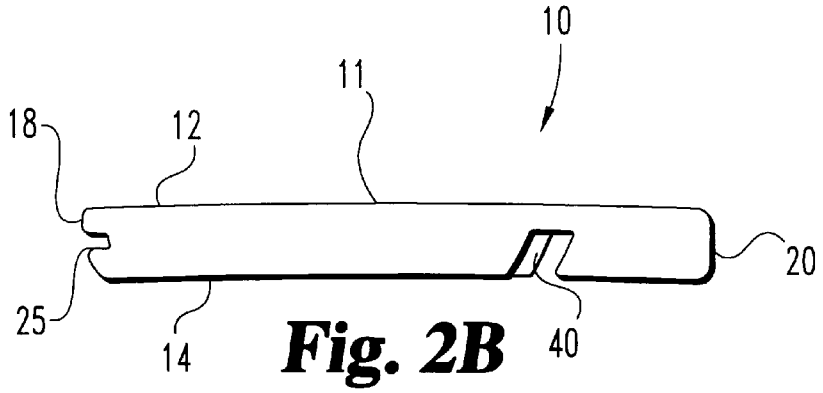
FIG. 2B is a perspective side view of the invention according to an alternate preferred embodiment.
Figure 3A:
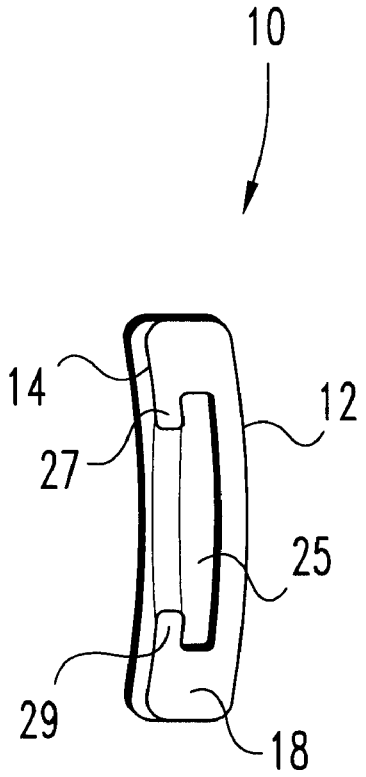
FIG. 3A is a perspective front-end view of the invention according to one preferred embodiment.
Figure 3B:
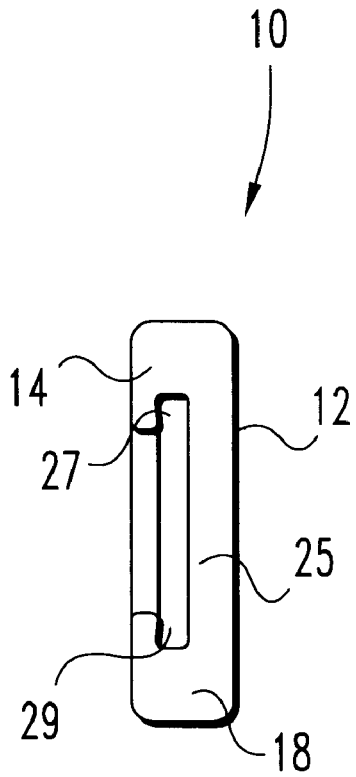
FIG. 3B is a perspective view front-end view of the invention according to an alternate preferred embodiment.

As shown in FIGS. 2A and 2B, lower face 14 and top face 12 of elongate body 11 may be curved in a lengthwise direction or may be flat. Similarly, as illustrated in FIGS. 3A and 3B, lower face 14 and top face 12 may be curved or flat in width. In an alternate embodiment (not shown) lower face 14 on top face 12 may be formed into a rough or non-continuous surface to form a grip for the user.

Internal channel 25 is preferably sized so that it is at least as high, at least as wide and at least as long as the tab on a container. Internal channel 25 is cut into recessed portion 35 of elongate member 11 so that cut-away section 32 is narrower and shorter than internal channel 25. At least two opposing tabs 27 and 29, formed from lower face 14, extend from the sides of elongate member 11 along the sides of cut-away section 32. In an alternate preferred embodiment, the height of internal channel 25 may vary in proportion to the distance from front end 18, preferably narrowing towards the distal portion of internal channel 25 vary the angle of the tab and to better grip the tab.

Figure 5:
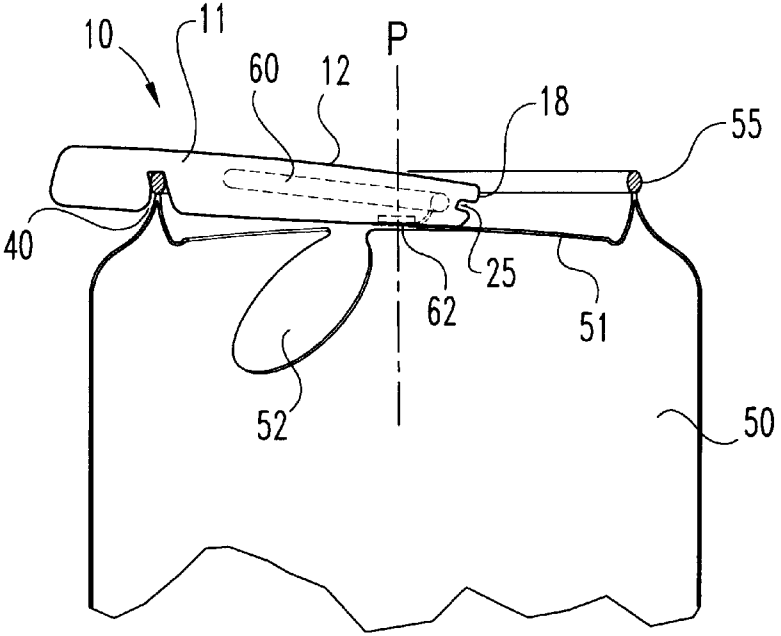
FIG. 5 is another perspective sectional side-view of a preferred embodiment of the present invention in use with a tab mounted on a beverage container.
Figure 4:
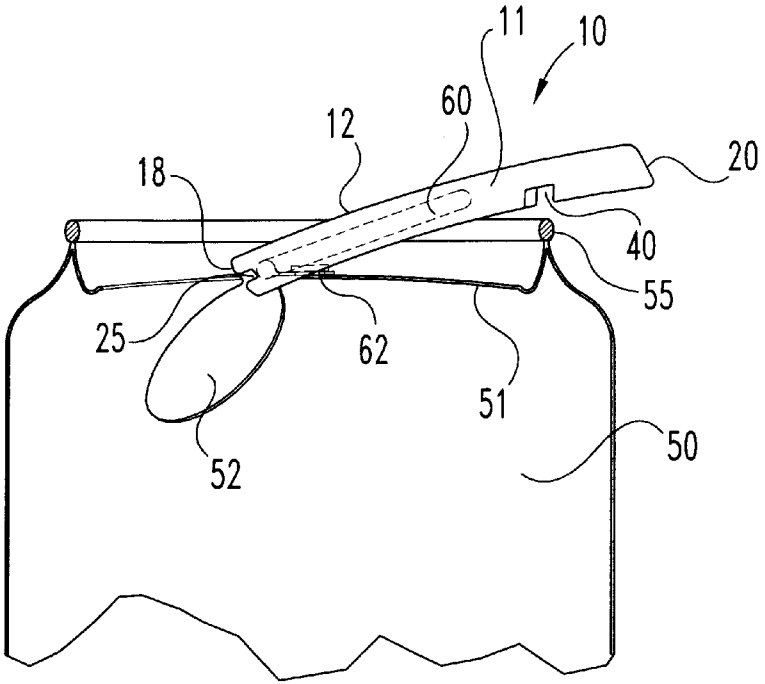
FIG. 4 is a perspective sectional side-view of a preferred embodiment of the present invention in use with a tab mounted on a beverage container.

As illustrated in FIGS. 4 and 5, tab 60 is mounted on lid 51 of can 50 at mounting point 62. Lid 51 has a scored section surrounding detachable flap 52 and circular rim 55 at the outer periphery. Tab 60 is centrally mounted to lid 51 at mounting point 62, preferably with a post having a broad head covering at least a piece of tab 60 and a shank passing through tab 60 and connected at the bottom to lid 51. Axis P runs through mounting point 62 and tab 60 may be rotated or pivoted around axis P at mounting point 62. Preferably mounting point 62 and axis P are located at the center of circular lid 51.

Tool 10 is preferably made of one-piece injection molded plastic. It would also be possible to form tool 10 from metal, wood or ceramic. In one preferred embodiment, top face 12 of elongate body 11 may be decorated with text, a graphic or a combination of the two. This could allow for advertising by establishment operators, beverage producers or other messages. In another preferred embodiment, elongate body 11 may be molded into novelty shapes such as a can, a bottle, a car or other designs which do not interfere with use of tool 10. Assorted combinations of designs and colors may be used. A further option includes a hole or stud in elongate body 11 so that tool 10 may be hung from a hook or mounted on a ring or keychain.

When used, tool 10 is slid around tab 60 so that tab 60 is held within internal chamber 25. Preferably at least a portion of lower face 14 of elongate body 11 is disposed between tab 60 and lid 51. Cut-away 32 allows tool 10 to be slid around tab 60 so that tab 60 enters recessed area 35 and mounting point 62 is situated within cut-away section 32. Opposing tabs 27 and 29 are below tab 60 and keep tab 60 from slipping out of tool 10. The front-end portions of opposing tabs 27 and 29 form part of front-end 18 and are preferably molded to be easily pushed underneath tab 60. Top face 12 of elongate body 11 substantially covers tab 60.

Once tool 10 is positioned around tab 60, distal end 20 is lifted. The lifting of distal end 20 causes front-end 18 and the end of tab 60 to impinge upon flap 52 outlined by scoring and causes flap 52 to break free from lid 51, opening can 50 so that the beverage may be consumed. With front-end 18 of tool 10 used in conjunction with the end of tab 60, a larger area of contact is made with flap 52 which allows flap 52 to be opened more easily and smoothly. Additionally, tool 10 is preferably longer than tab 60, so tool 10 provides a longer lever arm allowing a smoother opening movement with less force required. This smoothness and lower force helps prevent spills and aids people with short nails, who are protecting their nails or who open cans repetitively.

Once can 50 is open, distal end 20 is lowered so that groove 40 meets rim 55 of lid 51. Groove 40 is cut so that when tool 10 is pressed down and slightly forward, the outer rim of groove 40 engages and grips rim 55 with a snap or pressure fit. This serves to restrain tab 60 in an enclosed and generally flat position so that tab 60 is kept out of the user's way. Additionally, tab 60 remains in internal channel 25 and top face 12 continues to substantially cover tab 60 so that rough edges or holes in tab 60 do not contact facial hair or sensitive skin of the user.

Another feature, illustrated in FIG. 5, allows tool 10 enclosing tab 60 to be rotated 180° so that tool 10 and tab 60 substantially cover the opening in lid 51. This covering restricts access to the container so that insects such as bees, dust or other foreign matter have difficulty, and preferably cannot, enter the container and contaminate the beverage. This also protects the user from accidentally sipping or swallowing foreign matter.

In a further preferred embodiment, tool 10 is formed from a temperature sensitive material which changes color in response to the temperature of the container. Materials for this are known in the art and would allow people to determine if a particular container was sufficiently cold or if the container temperature had risen towards the ambient temperature. An alternate preferred embodiment includes a magnet attached to or incorporated within tool 10 so that tool 10 may, for convenience, be stored on a refrigerator or similar surface.

While the invention has been illustrated and described in detail in the drawings and description, these are to be considered as illustrative and not restrictive. It must be understood that only preferred embodiments have been shown and described and that all changes and modifications that come within the spirit of the invention are included where described by the following claims.

What is claimed is:

1. A tool for manipulating an opening tab mounted on a beverage container, consisting essentially of:

an elongate body with a front-end, a length, a top face and a lower face;

an internal channel defined within said elongate body beginning at an end of said elongate body and extending lengthwise within said elongate body, wherein said internal channel is sized at least as high, as least as wide and at least as long as the tab of a beverage container;

a cut-away in said lower face of said elongate body and in communication with said internal chamber to allow said elongate body to be positioned with the tab held within said internal channel and so that said elongate body extends past the site where the tab is mounted;

a groove defined in said lower face of said elongate body distally from said front-end, wherein said groove is sized and spaced to form a pressure fit with a rim of the container; and wherein said top face is sized to substantially cover the tab.

2. The tool of claim 1 wherein said lower face further comprises at least two opposing tabs disposed between the tab and the container for holding the tab within said internal channel.

3. The tool of claim 2 wherein said elongate body has a length between about 1⅜ and 2".

4. The tool of claim 3 wherein said elongate body has a length of about 1⅝".

5. The tool of claim 3 wherein the height of said internal channel decreases in proportion to the distance from the front-end of said elongate body.

6. The tool of claim 3 wherein said elongate body is one-piece injection molded plastic.

7. The tool of claim 6 wherein said tool is formed from a temperature sensitive material which changes color in response to temperature changes in the container.

8. A method for manipulating an opening tab mounted on the lid of a beverage container having a scored opening and an outer rim, comprising the steps of:

providing an elongate body having a front-end, an opposing distal end, a top face, a lower face, a groove in said lower face adjacent said distal end and an internal channel beginning in said front-end, said internal channel being sized at least as high, at least as wide and at least at long as the tab;

sliding said elongate body around the tab and past the point where the tab is mounted so that the top face of the elongate body substantially covers the tab wherein the tab is held within said internal channel;

levering said elongate body holding said tab by lifting said distal end of said elongate body so that the front-end of said elongate body and the end of the tab press against the scored opening until the container is open; and, lowering said elongate body until a groove in the lower face of said elongate body grips the rim of the container.

9. The method of claim 8 further comprising the step of rotating said elongate body holding the tab around the mounting point of the tab until said elongate body and tab substantially cover the opening of said container.

10. The tool of claim 8 further comprising a groove defined in said lower face of said elongate body distally from said front-end, wherein said groove is sized and spaced grip the rim of the container.

* * * * *